US008331811B2

(12) United States Patent
Miyazawa et al.

(10) Patent No.: US 8,331,811 B2
(45) Date of Patent: Dec. 11, 2012

(54) DEVELOPING DEVICE HAVING LIQUID DEVELOPER COATING MEMBERS, IMAGE FORMING APPARATUS, AND DEVELOPING METHOD USING THE SAME

(75) Inventors: Kazuma Miyazawa, Shiojiri (JP); Tsutomu Sasaki, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 117 days.

(21) Appl. No.: 12/603,404

(22) Filed: Oct. 21, 2009

(65) Prior Publication Data

US 2010/0104302 A1 Apr. 29, 2010

(30) Foreign Application Priority Data

Oct. 28, 2008 (JP) ..... 2008-276325

(51) Int. Cl.
*G03G 15/10* (2006.01)

(52) U.S. Cl. ..... 399/45; 399/57

(58) Field of Classification Search ..... 399/237–239, 399/265, 272, 279, 281, 45, 49, 53, 57, 60
See application file for complete search history.

(56) References Cited

U.S. PATENT DOCUMENTS

| | | | | |
|---|---|---|---|---|
| 5,963,968 | A * | 10/1999 | Warmus et al. | |
| 2005/0147431 | A1 * | 7/2005 | Takeuchi et al. | 399/237 |
| 2008/0069579 | A1 * | 3/2008 | Tabata et al. | 399/53 |

FOREIGN PATENT DOCUMENTS

| | | | |
|---|---|---|---|
| JP | 03051132 | A * | 3/1991 |
| JP | 2002-099151 | | 4/2002 |
| JP | 2002-287513 | | 10/2002 |
| JP | 2003241520 | A * | 8/2003 |
| JP | 2003241521 | A * | 8/2003 |
| JP | 2008209660 | A * | 9/2008 |

* cited by examiner

*Primary Examiner* — Walter L Lindsay, Jr.
*Assistant Examiner* — Milton Gonzalez
(74) *Attorney, Agent, or Firm* — DLA Piper LLP (US)

(57) ABSTRACT

A developing device includes: a developer storage portion which stores a liquid developer including toner and carrier liquid; a first coating member which rotates and coats the liquid developer stored in the developer storage portion; a second coating member which comes into contact with the first coating member and rotates in a direction opposite to that of the first coating member and slower than a rotary peripheral velocity of the first coating member; and a developer supporting body which comes into contact with the second coating member and rotates in the same direction as that of the second coating member and faster than a rotary peripheral velocity of the second coating member.

8 Claims, 10 Drawing Sheets

FIG. 10

| | ROLLER PERIPHERAL VELOCITY | | | DEVELOPER FILM STATE (CONCAVE/CONVEX UNEVENNESS EVALUATION) | DEVELOPER FILM THICKNESS |
|---|---|---|---|---|---|
| | Vdr | Var | Vmr | | |
| THERE IS NO PERIPHERAL VELOCITY DIFFERENCE BETWEEN SUPPLY ROLLER AND INTERMEDIATE ROLLER (Var=Vmr) | 214 mm/s | 428 mm/s | | ○ | 10 μm |
| | | 214 mm/s | | ○ | 5 μm |
| | | 150 mm/s | | × | 4 μm |
| | | 107 mm/s | | × | 3 μm |
| THERE IS PERIPHERAL VELOCITY DIFFERENCE BETWEEN SUPPLY ROLLER AND INTERMEDIATE ROLLER (Var>Vmr) | | 270 mm/s | 150 mm/s | ○ | 4 μm |
| | | 214 mm/s | | ○ | 4 μm |
| | | 270 mm/s | 107 mm/s | ○ | 3 μm |
| | | 214 mm/s | | ○ | 3 μm |

FIG. 12

| KIND OF PAPER | ROLLER DRIVE | PAPER ROUGHNESS Rz | DEVELOPER FILM THICKNESS | SOLID CONTENT AMOUNT ON PAPER |
|---|---|---|---|---|
| COATED PAPER (e.g. ZANDERS, IKONO SILK PAPER) | CONDITION EXPRESSION (2) | 7 μm | 3 μm | 0.04 mg/cm$^2$ |
| STANDARD PAPER (J PAPER) | CONDITION EXPRESSION (1) | 30 μm | 5 μm | 0.08 mg/cm$^2$ |
| ROUGH PAPER (e.g. NEENABOND PAPER) | CONDITION EXPRESSION (3) | 50 μm | 8 μm | 0.11 mg/cm$^2$ |

DEVELOPING DEVICE HAVING LIQUID DEVELOPER COATING MEMBERS, IMAGE FORMING APPARATUS, AND DEVELOPING METHOD USING THE SAME

BACKGROUND

1. Technical Field

The present invention relates to a developing device and a developing method, which develop an electrostatic latent image formed on an image supporting body, by a liquid developer including toner and carrier liquid, and an image forming apparatus which forms an image by transferring a developer image developed by a developing device to a recording medium and fixing the image.

2. Related Art

There have been proposed a variety of image forming apparatuses which develop and visualize an electrostatic latent image by using a liquid developer of high viscosity, in which toner composed of solid components is dispersed in liquid solvent serving as carrier liquid. The developer used in the image forming apparatus is a developer in which solid components (toner particles) are suspended in organic solvent (carrier liquid) of high viscosity which is composed of silicon oil, mineral oil, edible oil, or the like and has electrical insulation properties. As for the toner particle, an extremely minute particle having a particle diameter approximately of 1 μm is used, thereby being able to achieve higher image quality in comparison with conventional dry type image forming apparatuses which use a toner particle having a particle diameter of 7 μm.

As for an image forming apparatus which uses such a liquid developer, for example, in JP-A-2002-99151, there is disclosed an image forming apparatus which sought for the improvement in development efficiency by uniformly coating a liquid developer on a developing roller through the adjustment of the contact pressure of a blade coming into contact with an anilox roller or the adjustment of the rotary speed of the anilox roller.

Also, in JP-A-2002-287513, there is disclosed an image forming apparatus in which an intermediate roller is provided between a coating roller and a developing roller and the intermediate roller and the coating roller are rotated at the same speed and in the same direction as each other. According to this image forming apparatus, since the developing roller does not come into direct contact with the coating roller, abrasion and damage due to a recessed portion formed in the surface of the coating roller do not occur, so that the developing roller suffers reduced mechanical stress, whereby the life of the developing roller can be prolonged.

In this manner, in the image forming apparatuses which use a liquid developer, a coating roller (anilox roller) having a recessed portion in its surface is used in order efficiently to scoop up the liquid developer and also precisely to measure the liquid developer.

However, in a case where the coating roller (anilox roller) with a recessed portion formed in the surface in this way is used, the transfer pattern of the liquid developer by the recessed portion appears, thereby leading to unevenness in the film thickness of the liquid developer. In particular, in JP-A-2002-287513, as can be seen in the graph of FIG. 8 thereof showing the relationship between the roller velocity ratio of the developing roller and the intermediate roller and the coating amount of the liquid developer which is coated on the developing roller, a region where the roller velocity ratio is 1.0 or less becomes a non-uniform region, and therefore cannot be used for image formation.

In an image forming apparatus, the resolution of an image formed can be improved by reducing the coating amount of the developer which is coated on the developing roller (by thinning the film thickness of the liquid developer). However, in the image forming apparatus disclosed in JP-A-2002-287513, since the lower limit of the coating amount, that is, the film thickness of the liquid developer is restricted, higher resolution cannot be realized.

In addition, in a developing device, it is necessary to change the amount of a supplied liquid developer according to the kind of a paper or required image density on a paper. For example, in a coarse paper such as a rough paper, in order to obtain the same on-paper concentration as that on a plain paper, it is necessary to supply more liquid developer. On the other hand, in a coated paper (smooth paper), the same on-paper concentration can be realized by the supply of the amount of a liquid developer which is less than that in a plain paper. If a broad control range of the film thickness of a liquid developer can be secured so as to be able to enlarge the range of the supply amount of the liquid developer, printing on various kinds of papers can be assured and it is also possible flexibly to accommodate to the change of concentration.

SUMMARY

An advantage of some aspects of the invention is that it provides a developing device, an image forming apparatus, and a developing method, which can accommodate to a broad-ranging paper kind or image density by enlarging a control range of the film thickness of a liquid developer which is formed on a developing roller.

According to a first aspect of the invention, there is provided a developing device including: a developer storage portion which stores a liquid developer including toner and carrier liquid; a first coating member which rotates and coats the liquid developer stored in the developer storage portion; a second coating member which comes into contact with the first coating member and rotates in a direction opposite to that of the first coating member and slower than a rotary peripheral velocity of the first coating member; and a developer supporting body which comes into contact with the second coating member and rotates in the same direction as that of the second coating member and faster than a rotary peripheral velocity of the second coating member.

Also, the developing device according to the first aspect further may include: a first changing section which changes the rotary peripheral velocity of the first coating member; and a second changing section which changes the rotary peripheral velocity of the second coating member.

Further, according to a second aspect of the invention, there is provided an image forming apparatus including: a liquid developer concentration adjusting section which adjusts a toner concentration of a liquid developer including toner and carrier liquid; a supply section which supplies the liquid developer with the toner concentration adjusted at the liquid developer concentration adjusting section; a developing section including a developer storage portion which stores the liquid developer supplied by the supply section, a first coating member which rotates and coats the liquid developer stored in the developer storage portion, a second coating member which comes into contact with the first coating member and rotates in a direction opposite to that of the first coating member and slower than a rotary peripheral velocity of the first coating member, and a developer supporting body which comes into contact with the second coating member and rotates in the same direction as that of the second coating member and faster than a rotary peripheral velocity of the second coating member; and a latent image supporting body which is developed by the developing section.

Also, the image forming apparatus according to the second aspect further may include: a first changing section which changes the rotary peripheral velocity of the first coating member; and a second changing section which changes the rotary peripheral velocity of the second coating member.

Also, the image forming apparatus according to the second aspect further may include: a paper information input section which inputs paper information; a memory section having paper correspondence information which correlates the paper information with the rotary peripheral velocity of the first coating member and the rotary peripheral velocity of the second coating member; and a control section which controls the rotary peripheral velocity of the first coating member and the rotary peripheral velocity of the second coating member on the basis of the paper correspondence information.

Also, the image forming apparatus according to the second aspect further may include: an image density information input section which inputs image density information; a memory section having image density correspondence information which correlates the image density information with the rotary peripheral velocity of the first coating member and the rotary peripheral velocity of the second coating member; and a control section which controls the rotary peripheral velocity of the first coating member and the rotary peripheral velocity of the second coating member on the basis of the image density correspondence information.

Also, the image forming apparatus according to the second aspect further may include: an input section which inputs paper information and image density information; a memory section having correspondence information which correlates the paper information and the image density information with the rotary peripheral velocity of the first coating member and the rotary peripheral velocity of the second coating member; and a control section which controls the rotary peripheral velocity of the first coating member and the rotary peripheral velocity of the second coating member on the basis of the correspondence information.

Further, according to a third aspect of the invention, there is provided a developing method including: coating, by a rotating first coating member, a liquid developer including toner and carrier liquid, which is stored in a developer storage portion, on a second coating member which rotates in a direction opposite to that of the first coating member and has a rotary peripheral velocity slower than a rotary peripheral velocity of the first coating member; and coating, by the second coating member on which the liquid developer has been coated, the liquid developer on a developer supporting body which rotates in the same direction as that of the second coating member and has a rotary peripheral velocity faster than the rotary peripheral velocity of the second coating member.

BRIEF DESCRIPTION OF THE DRAWINGS

The invention will be described with reference to the accompanying drawings, wherein like numbers reference like elements.

FIG. 10 is a view showing each roller peripheral velocity, a developer film thickness, and the evaluation result of a film state.

FIG. 12 is a view showing a condition that image density becomes constant for the kinds of papers different in roughness.

DESCRIPTION OF EXEMPLARY EMBODIMENTS

Figure 1:
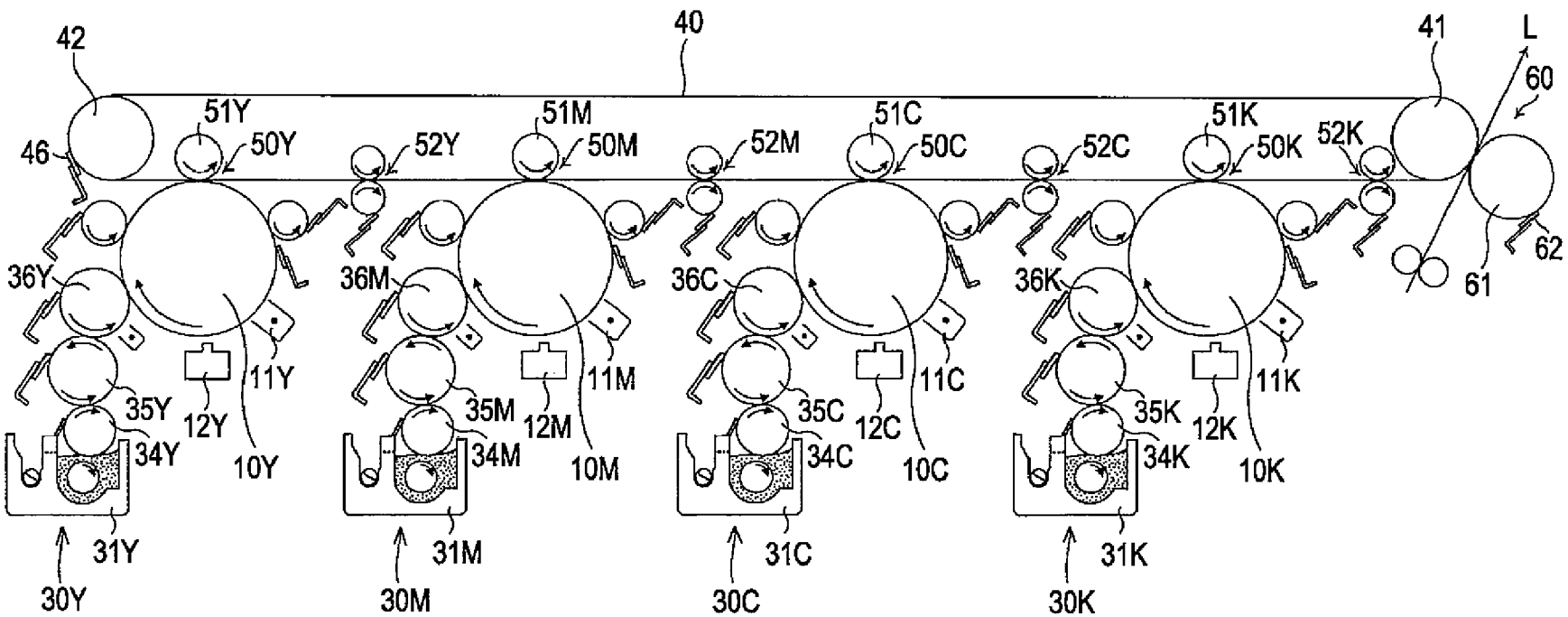
FIG. 1 is a cross-sectional view showing the main components of an image forming apparatus related to an embodiment of the invention.

Hereinafter, embodiments of the invention will be described with reference to the drawings. FIG. 1 is a view showing the main components of an image forming apparatus related to an embodiment of the invention. With respect to an image forming section disposed at the central section of the image forming apparatus, four developing device 30Y, 30M, 30C, and 30K are disposed below the image forming section, and an intermediate transferring body 40 and a secondary transferring section (a secondary transferring unit 60) are disposed above the image forming section. The image forming section and the developing device 30Y, 30M, 30C, and 30K are described below. However, since the configurations for the respective colors are the same, the description will be made with alphabets of the additional characters representing colors omitted. Further, although the image forming apparatus of this embodiment is an apparatus capable of forming a full-color image by four colors of YMCK, the image forming apparatus is not limited to this embodiment, but may also be an image forming apparatus in which an appropriate color number including, for example, a single color is adopted.

The image forming section includes an image supporting body 10, a corona electrical charger 11, an exposure unit 12, and the like. The exposure unit 12 includes a semiconductor laser and an optical system including a polygon mirror, an F-θ lens, and the like and forms an electrostatic latent image by irradiating the electrified image supporting body 10 with modulated laser light on the basis of an input image signal.

The developing device 30 generally includes a developer vessel 31 which stores a liquid developer of each color, a supply roller 34 which coats the liquid developer from the developer vessel 31 to an intermediate roller 35, and the like, and develops the electrostatic latent image formed on the image supporting body 10 by the liquid developer of each color. The intermediate transferring body 40 is constituted by an endless belt or the like, mounted in a tensioned state on a driving roller 41 and a tension roller 42, and rotationally driven by the driving roller 41 while coming into contact with the image supporting body 10 in a primary transferring section 50. In the primary transferring section 50, the image supporting body 10 and a primary transferring backup roller 51 are disposed to face each other with the intermediate transferring body 40 interposed therebetween, and the toner images of the respective colors on the developed image supporting bodies 10 are transferred in sequence in layers to the intermediate transferring body 40 with a contact position where each image supporting body 10 comes into contact with the intermediate transferring body 40 as a transfer position, so that a full-color toner image is formed.

In the secondary transferring section 60, a secondary transferring roller 61 is disposed to face the driving roller 41 with the intermediate transferring body 40 interposed therebetween. Further, a secondary transferring roller cleaning blade 62 is disposed in contact with the secondary transferring roller 61. Then, in a transfer position of the secondary transferring roller 61, a monochromatic toner image or a full-color toner image formed on the intermediate transferring body 40 is transferred to a recording medium such as a paper, a film, or cloth, which is transported in a sheet material transportation path L.

Then, on the downstream side of the sheet material transportation path L, a fixing unit (not shown) is disposed and fixes the monochromatic toner image or the full-color toner image, which has been transferred to the recording medium such as a paper, to the recording medium such as a paper by fusing and bonding. Further, the tension roller 42 supports in a tensioned state the intermediate transferring body 40 along with the driving roller 41, and an intermediate transferring body cleaning blade 46 is disposed so as to be in contact with the intermediate transferring body 40 at a place where the intermediate transferring body 40 passes around the tension roller 42.

Figure 2:
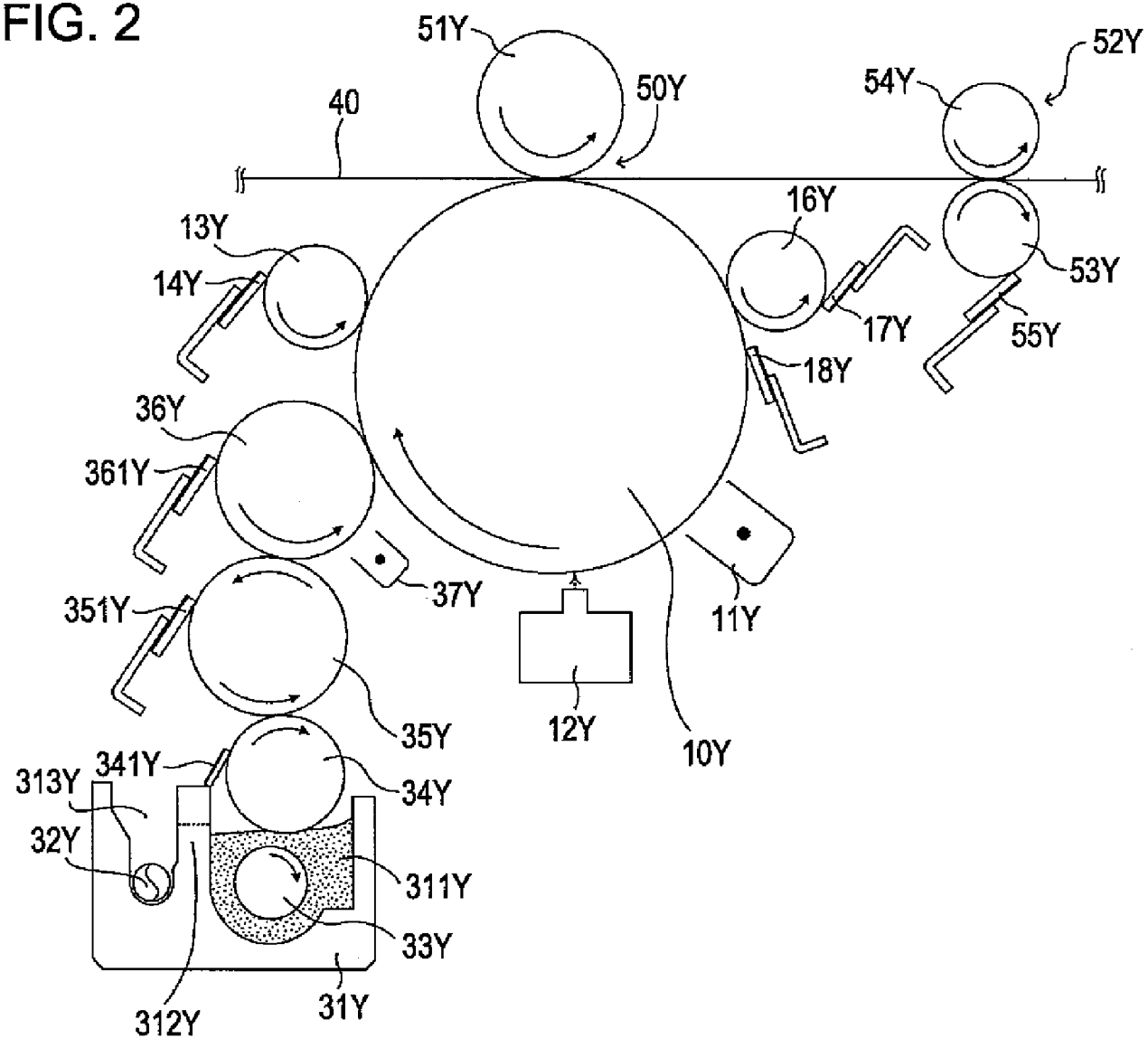
FIG. 2 is a cross-sectional view showing the main components of an image forming section and a developing device.

Next, the image forming section and the developing device related to the embodiment of the invention is described. FIG. 2 is a cross-sectional view showing the main components of the image forming section and the developing device 30. Since the image forming sections and developing devices for the respective colors are the same, description is made based on the image forming section and developing device for yellow (Y) and alphabets of the additional characters are omitted.

On the periphery of the image supporting body 10, along the rotation direction thereof, an image supporting body cleaning roller 16, an image supporting body cleaning blade 18, the corona electrical charger 11, the exposure unit 12, a developing roller 36 of the developing device 30, and an image supporting body squeeze roller 13 are disposed. Further, an image supporting body cleaning roller cleaning blade 17 is disposed so as to be in contact with the image supporting body cleaning roller 16, and an image supporting body squeeze roller cleaning blade 14, which is an auxiliary component of the image supporting body squeeze roller 13, is disposed in contact with the image supporting body squeeze roller 13.

Further, the primary transferring backup rollers 51 of the primary transferring sections 50 are disposed at the positions facing the image supporting bodies 10 along the intermediate transferring body 40, and on the downstream side of the primary transferring backup roller 51 along the moving direction of the intermediate transferring body 40, an intermediate transferring body squeeze device 52 is disposed which is composed of an intermediate transferring body squeeze roller 53, an intermediate transferring body squeeze backup roller 54, and an intermediate transferring body squeeze roller cleaning blade 55.

The image supporting body 10 is a photo conductor drum constituted of a cylindrical member which is broader in width than the developing roller 36 and has a photosensitive layer formed on the outer circumferential surface thereof, and rotates, for example, in the clockwise direction, as shown in FIG. 2. The photosensitive layer of the image supporting body 10 is constituted of an organic image supporting body, an amorphous silicon image supporting body, or the like. The corona electrical charger 11 is disposed on the upstream side of a nip portion of the image supporting body 10 and the developing roller 36 in the rotation direction of the image supporting body 10 and corona-charges the image supporting body 10 by application of a voltage from a power supply device (not shown). The exposure unit 12 irradiates the image supporting body 10 electrified by the corona electrical charger 11 with laser light at the downstream side of the corona electrical charger 11 in the rotation direction of the image supporting body 10, thereby forming an electrostatic latent image on the image supporting body 10.

The developing device 30 includes, as the main components, the developing roller 36, the intermediate roller 35, the supply roller 34, the developer vessel 31 which stores the liquid developer in which toner is dispersed about 20% in ratio by weight in a carrier, a toner compression corona generator 37 which performs compaction action on the developer. On the periphery of the developing roller 36, a cleaning blade 361, the intermediate roller 35, and the toner compression corona generator 37 are disposed. The intermediate roller 35 comes at its surface into contact with the developing roller 36 and the supply roller 34. A regulating blade 341 which adjusts the amount of the liquid developer scooped up from a developer storage portion 311 is brought into contact with the supply roller 34. Further, since the intermediate roller 35 has the function of adjusting the amount of the liquid developer by coming into contact with the supply roller 34, the regulating blade 341 may also be omitted.

In the liquid developer vessel 31, there are formed the developer storing portion 311 and a recovered liquid storage portion 313 with a partition portion 312 as a wall portion interposed therebetween. A transporting screw 33 is accommodated in the developer storage portion 311 and a recovery screw 32 is accommodated in the recovered liquid storage portion 313. Also, the recovered liquid storage portion 313 is provided with the recovery screw 32 which recovers the liquid developer that did not contribute to image forming.

A supply portion which supplies the liquid developer to the developer storage portion 311 is connected to the liquid developer vessel 31. The supply portion scoops up the liquid developer with concentration adjusted at a liquid developer concentration adjusting section by a pump and transports the liquid developer to the liquid developer storage portion 311 through a supply port provided at the developer vessel 31. The liquid developer which is supplied to the developer storage portion 311 is not heretofore a commonly used volatile liquid developer of low concentration (1~2 wt %) and low viscosity using Isopar (brand mark: manufactured by Exxon Corporation) as a carrier and having volatility at a normal temperature, but a liquid developer of high concentration and high viscosity (about 30~10000 mPa·S), in which a solid material of 1 μm average grain diameter having a coloring agent such as pigment dispersed in non-volatile resin at a normal temperature is added along with a dispersant to liquid solvent such as organic solvent, silicon oil, mineral oil, or edible oil and toner solid content concentration is about 20%.

The supply roller 34 which is a first coating member in the invention has the function of supplying the liquid developer to the intermediate roller 35. The supply roller 34 is a roller which is a cylindrical member and is formed with a recessed portion pattern by a helical groove or the like helically engraved finely and uniformly in the surface so as easily to support the liquid developer on the surface. The liquid developer scooped up by the recessed portion pattern is precisely measured at the regulating blade 341 which comes into contact with the supply roller, and then supplied to the intermediate roller 35. In the operation of the device, as shown in FIG. 2, the transporting screw 33 rotates in the clockwise direction, thereby supplying the liquid developer to the supply roller 34, and the supply roller 34 rotates in the clockwise direction, thereby coating the liquid developer on the intermediate roller 35.

The regulating blade 341 is a metallic blade or an elastic blade having a surface covered with an elastic body. In this embodiment, the regulating blade is constituted of a rubber portion made of urethane rubber or the like and being brought into contact with the surface of the supply roller 34, and a plate made of metal or the like and supporting the rubber portion. Then, the regulating blade regulates and adjusts the film thickness and the amount of the liquid developer supported and transported by the supply roller 34, thereby adjusting the amount of the liquid developer which is supplied to the intermediate roller 35. Also, in place of the regulating blade 341, a regulating roller constituted of a roller may also be used. Further, in this embodiment, since the intermediate roller 35 has the function of adjusting the amount of the liquid developer as in the regulating blade 341 or the regulating roller, the regulating blade 341 or the regulating roller may not be provided.

The developing roller 36 which is a developer supporting body in the invention is a cylindrical member and rotates in the counter-clockwise direction about a rotary shaft, as shown in FIG. 2. The developing roller 36 is constituted by an inner core made of metal such as iron and an elastic layer, such as a tube of polyurethane rubber, silicon rubber, NBR, PFA, or the like, provided on the outer circumferential portion of the core. The developing roller cleaning blade 361 is constituted of rubber or the like which is brought into contact with the surface of the developing roller 36, and disposed on the downstream side of a developing nip portion where the developing roller 36 comes into contact with the image supporting body 10, in the rotation direction of the developing roller 36, so as to scrape off and remove the liquid developer remaining on the developing roller 36.

The intermediate roller 35 which is a second coating member in the invention is a cylindrical member and rotates in the counter-clockwise direction, similarly to the developing roller 36, about a rotary shaft, as shown in FIG. 2, thereby coming into counter-contact with the developing roller 36. The intermediate roller 35 is constituted by an inner core made of metal and an elastic layer provided on the outer circumferential portion of the core, similarly to the developing roller 36. The intermediate roller cleaning blade 351 is provided on the downstream side of the contact position where the intermediate roller 35 comes into contact with the developing roller 36, and scrapes off the liquid developer which has not been supplied to the developing roller 36, thereby recovering it to the recovered liquid storage portion 313.

The toner compression corona generator 37 is a electric field applying section which increases the electrifying bias of the surface of the developing roller 36, and the liquid developer transported by the developing roller 36 is applied with an electric field at a position adjacent to the toner compression corona generator 37, so that toner compression is performed. Further, as the electric field applying section for the toner compression, in place of the corona discharging of a corona discharger, a compaction roller or the like may also be used. The compaction roller is a cylindrical member, has a structure having an electrically conductive resin layer or rubber layer provided on the surface of a metallic roller base material, and preferably is constructed so as to rotate in the clockwise direction opposite to the rotation direction of, for example, the developing roller 36.

On the other hand, the toner-compressed liquid developer supported on the developing roller 36 is developed corresponding to the electrostatic latent image of the image supporting body 10 by a desired electric field in the developing nip portion where the developing roller 36 comes into contact with the image supporting body 10. Then, the developer which did not contribute to the development is scraped off by the developing roller cleaning blade 361 and drops into the recovered liquid storage portion 313 of the developer vessel 31. The dropped developer is adjusted in concentration at the liquid developer concentration adjusting section, and supplied to the developer storage portion 311 again, thereby being reused.

An image supporting body squeeze device, which is disposed on the upstream side of the primary transfer position, is disposed on the downstream side of the developing roller 36 to face the image supporting body 10 and recovers the surplus developer of the developed toner image on the image supporting body 10. The image supporting body squeeze device is constituted by the image supporting body squeeze roller 13 which is constituted of an elastic roller member having a surface covered with an elastic body and rotating in sliding-contact with the image supporting body 10, and the cleaning blade 14 which comes into sliding-contact with and presses the image supporting body squeeze roller 13, thereby cleaning the surface of the image supporting body squeeze roller, and has the function of recovering a surplus carrier from the developed developer on the image supporting body 10, thereby increasing a toner particle proportion in a visible image. As for the image supporting body squeeze device before the primary transfer, in this embodiment, the single image supporting body squeeze roller 13 is provided. However, a plurality of image supporting body squeeze rollers may also be provided. In this case, a configuration may also be made such that the image supporting body squeeze rollers to be brought into contact with or separated from are changed over according to a liquid developer state or the like.

In the primary transferring section 50, the developed developer image on the image supporting body 10 is transferred to the intermediate transferring body 40 by the primary transferring backup roller 51. Here, since the image supporting body 10 and the intermediate transferring body 40 are moved at the same speed, a drive load due to rotation and movement is reduced and the disturbance action of the image supporting body 10 on the toner image of the visible image is also suppressed.

An image supporting body cleaning device is disposed on the downstream side of the primary transferring section 50 to face the image supporting body 10, thereby cleaning the liquid developer left after transfer or the un-transferred liquid developer on the image supporting body 10. The image supporting body cleaning roller 16 is applied with such a bias voltage as to attract the toner particles in the liquid developer. Therefore, the developer recovered by the image supporting body cleaning roller 16 is a solid-rich liquid developer with many toner particles contained. The solid-rich liquid developer recovered by the image supporting body cleaning roller 16 is scraped off by the image supporting body cleaning roller cleaning blade 17 which comes into contact with the image supporting body cleaning roller 16, and then drops vertically.

The intermediate transferring body squeeze device 52 is constituted by the intermediate transferring body squeeze roller 53 composed of an elastic roller member which has a surface covered with an elastic body and rotates in sliding-contact with the intermediate transferring body 40, the backup roller 54 disposed to face the intermediate transferring body squeeze roller 53 with the intermediate transferring body 40 interposed therebetween, and the cleaning blade 55 which comes into sliding-contact with and presses the intermediate transferring body squeeze roller 53, thereby cleaning the surface of the intermediate transferring body squeeze roller. Also, the intermediate transferring body squeeze device 52 has the function of recovering a surplus carrier and the like from the developer primarily transferred to the intermediate transferring body 40.

Figure 3:
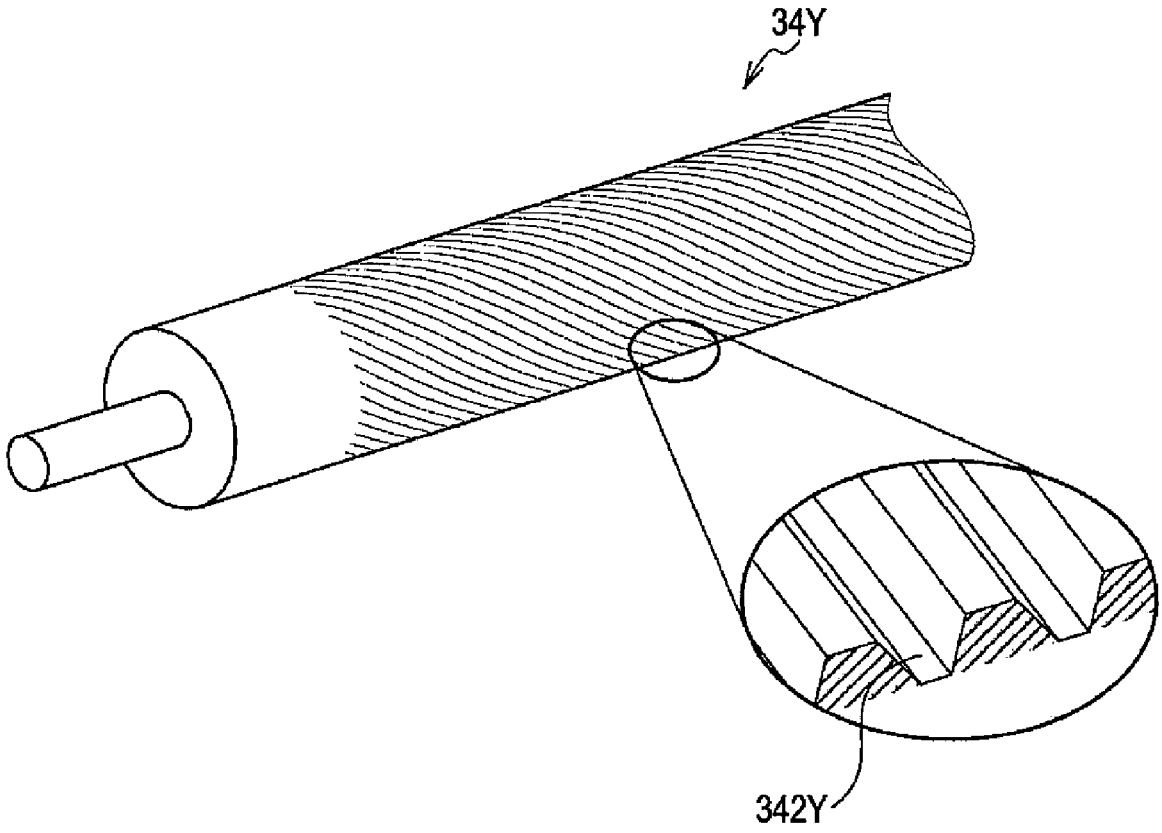
FIG. 3 is a perspective view of a supply roller related to the embodiment of the invention.

The developing device and the image forming apparatus related to the embodiment of the invention have been described above. Next, the supply roller 34 which is the coating member used in the developing device and the image forming apparatus according to the invention is described. FIG. 3 shows a perspective view of the supply roller 34 used in the invention and an enlarged view of a portion thereof. The supply roller 34 in the invention has a recessed portion pattern forming region provided at the central portion of the surface thereof, as shown by the oblique lines in the drawing. The recessed portion pattern forming region is intended for the precise measurement of the liquid developer and the improvement of supply efficiency, and in this embodiment, adopts a helical groove 342. However, it is not limited to this embodiment, but, for example, a variety of shapes and arrays such as a pyramid-shaped recessed portion shape and a lattice recessed portion array may also be adopted. When the supply roller 34 rotates, the recessed portion-formed pattern scoops up the liquid developer and supplies it to the intermediate roller 35.

Figure 4B:
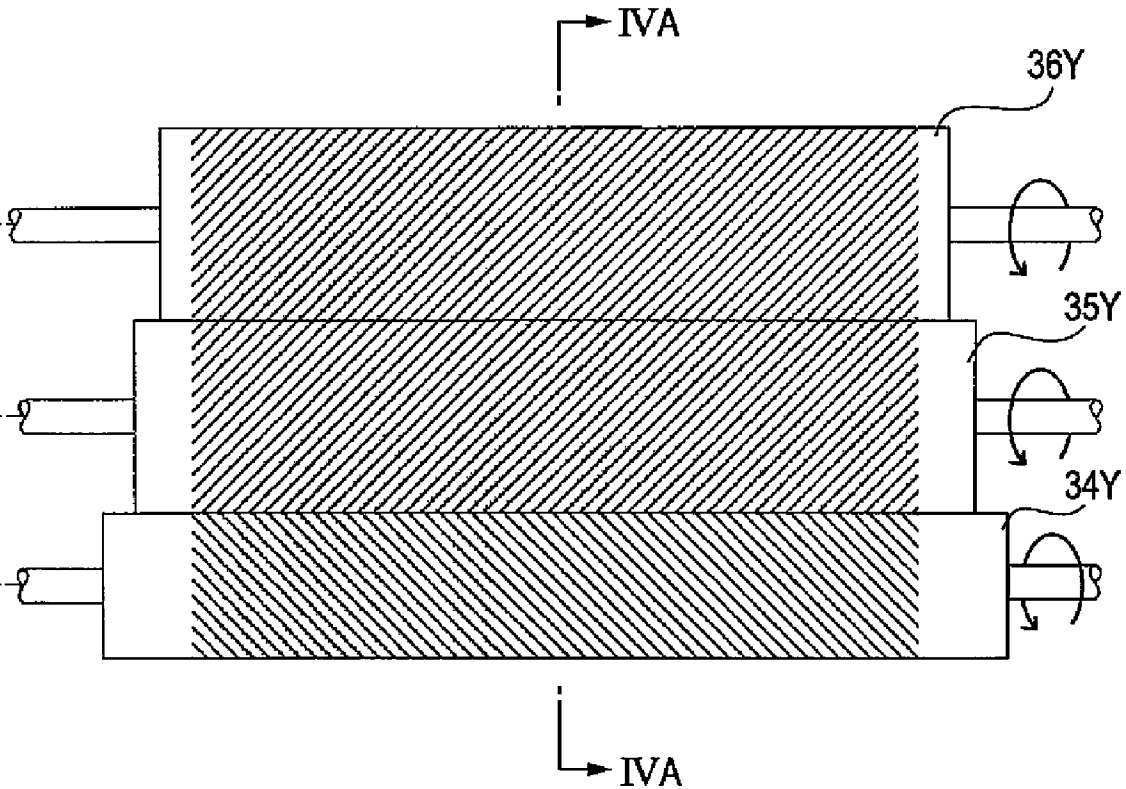
FIGS. 4A and 4B respectively are a cross-sectional view of the developing device related to the embodiment of the invention and a view showing the aspect of a transfer pattern.
Figure 4A:
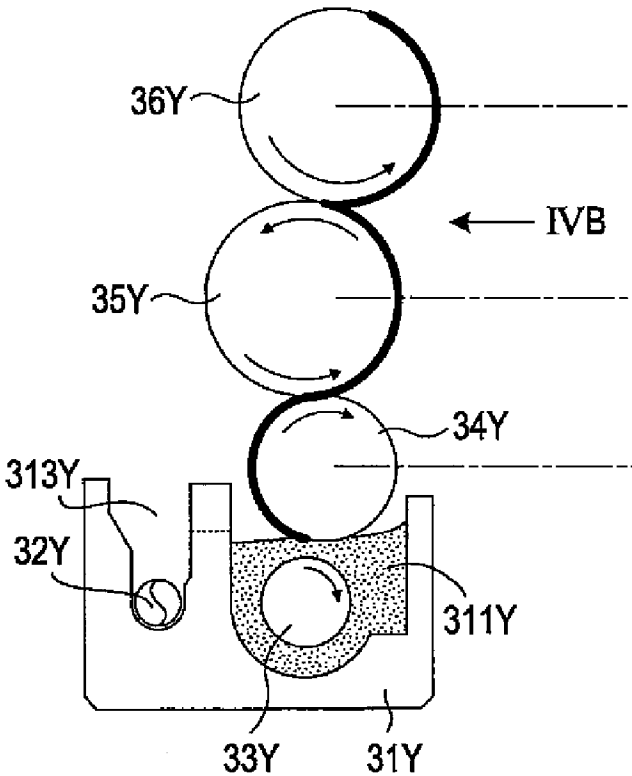
Figure 5A:
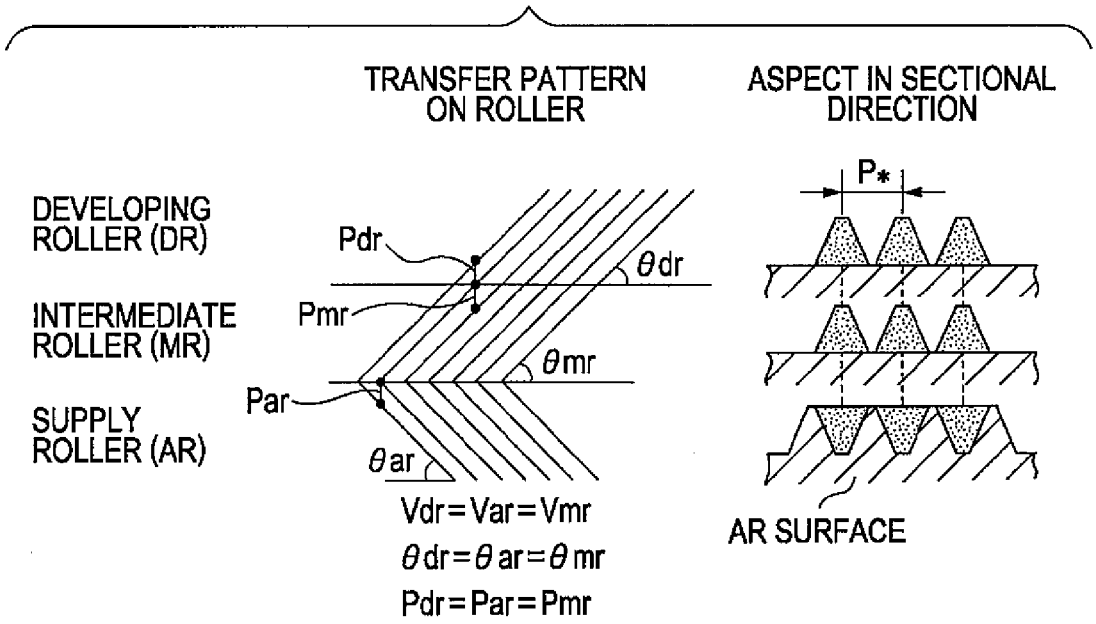
FIGS. 5A and 5B are views explaining the transfer pattern by the supply roller.
Figure 5B:
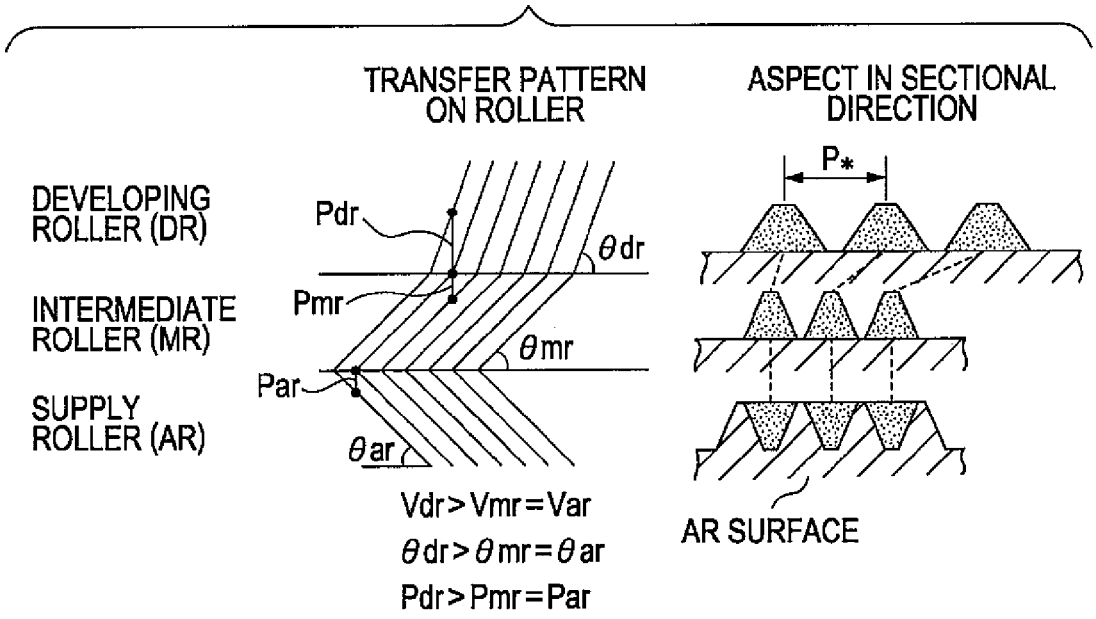

Next, the aspect of the transfer pattern of the liquid developer by a recessed portion pattern formed in the supply roller 34 is described using FIGS. 4A and 4B and FIGS. 5A and 5B. FIG. 4A is a cross-sectional view of the developing device and FIG. 4B is a view showing the aspect of the transfer pattern in each roller. Also, FIGS. 5A and 5B are views explaining the transfer pattern by the supply roller 34.

FIG. 4A is a cross-sectional view taken along line IVA-IVA of FIG. 4B, and the thick lines described on the surfaces of the supply roller 34, the intermediate roller 35, and the developing roller 36 show an aspect where the liquid developer scooped up from the developer storage portion 311 is transferred. Also, the surrounding configuration of each roller is omitted. First, the liquid developer stored in the developer storage portion 311 is scooped up by the supply roller 34 which rotates in the clockwise direction, and supplied to the intermediate roller 35 which rotates in the counter-clockwise direction and comes into contact with the supply roller 34 in the forwardly direction. The liquid developer supplied to the intermediate roller 35 is supplied to the developing roller 36 which rotates in the counter-clockwise direction and comes into contact with the intermediate roller 35 in the reverse direction. Then, the liquid developer supplied to the developing roller 36 is supplied to the image supporting body 10 (not shown in this drawing), thereby forming an image.

Since the helical groove 342 described in FIG. 3 is formed in the surface of the supply roller 34 of this embodiment, the liquid developer scooped up by the supply roller 34 forms the transfer patterns of the liquid developer on the surfaces of the intermediate roller 35 and the developing roller 36. The aspects of the transfer patterns are shown in FIG. 4B. FIG. 4B is a view when FIG. 4A is viewed from the direction indicated by symbol IVB, and shows the aspect of the transfer pattern in each roller. As shown in the drawing, in a case where the helical groove 342 formed in the supply roller 34 is a diagonally right down pattern, the transfer patterns of the liquid developer on the surfaces of the intermediate roller 35 and the developing roller 36 become the same as those shown in the drawing. Specifically, a diagonally right up transfer pattern is formed on the surface of the intermediate roller 35 which comes into contact with the supply roller 34 in the forwardly direction, and a diagonally right up transfer patterns is also formed on the surface of the developing roller 36 which comes into contact with the intermediate roller 35 in the reverse direction.

FIGS. 5A and 5B are views explaining the relationship between the aspect of the transfer pattern in each roller and the relative velocity of each roller. FIG. 5A shows the transfer pattern in each roller in a case where the rotary peripheral velocity Vdr of the developing roller 36, the rotary peripheral velocity Vmr of the intermediate roller 35, and the rotary peripheral velocity Var of the supply roller 34 are the same. Here, the term "rotary peripheral velocity" is to mean a tangential velocity of the surface of each roller at the time of rotation. As described in FIGS. 4A and 4B, as to the transfer pattern which is formed on each roller, in this embodiment in which the recessed portion pattern is composed of a helical groove, the transfer pattern shown by the oblique lines in the drawing is formed.

Here, assuming that the acute angle that the helical groove 342 of the supply roller 34 makes with the axial direction is $\theta ar$, the acute angle that the transfer pattern of the intermediate roller 35 makes with the axial direction is $\theta mr$, and the acute angle that the transfer pattern of the developing roller 36 makes with the axial direction is $\theta dr$, in a case where the rotary peripheral velocities of the respective rollers are the same, the acute angles that the transfer patterns of the respective rollers make with their axial directions are the same and the relationship of $\theta ar=\theta mr=\theta dr$ is established. Also, as to the distance (pitch distance P*) between the adjacent oblique lines in a direction perpendicular to the axial direction, the pitch distance Par in the supply roller 34, the pitch distance Pmr in the intermediate roller 35, and the pitch distance Pdr in the developing roller 36 all become the same. In this manner, in a case where the rotary peripheral velocities of the respective rollers are the same, the pitch distances of the transfer patterns become the same as the pitch distance of the helical groove 342 formed in the supply roller 34. Since the pitch distance Par of the helical groove 342 usually is set to be a distance considered such that the film thickness of the liquid developer formed on the developing roller 36 does not become uneven, in a case where the pitch distance Par of the supply roller 34 and the pitch distance Pdr of the developing roller 36 are the same, no problem occurs in the film thickness of the liquid developer on the developing roller 36.

Next, a case where the rotary peripheral velocity Vdr of the developing roller 36 is set to be faster than the rotary peripheral velocity Vmr of the intermediate roller 35 and the rotary peripheral velocity Var of the supply roller 34 ($Vdr>Vmr=Var$) is described using FIG. 5B. In the case of thinning the film thickness of the liquid developer which is formed on the surface of the developing roller 36, making the rotary peripheral velocity of the roller (in this embodiment, the intermediate roller 35) which comes into contact with the developing roller 36, slower than the rotary peripheral velocity Vdr of the developing roller 36 is done. This leads to the delay of the liquid developer due to a rotary peripheral velocity difference. FIG. 5B shows the transfer pattern on each roller in this case.

The transfer pattern on the surface of the intermediate roller 35 is the same as the case of FIG. 5A, and the acute angle θmr that the transfer pattern on the intermediate roller 35 makes with the axial direction is the same as the acute angle θar that the helical groove 342 of the supply roller 34 makes with the axial direction. Also, the pitch distance Par in the supply roller 34 is the same as the pitch distance Pmr of the intermediate roller 35.

On the other hand, the transfer pattern formed on the surface of the developing roller 36 with the rotary peripheral velocity set to be faster than that of the intermediate roller 35, becomes a state of being stood up in comparison with the transfer pattern on the intermediate roller 35, as shown in the drawing. Specifically, the acute angle θdr that the transfer pattern on the developing roller 36 makes with the axial direction becomes larger than the other angles and the pitch distance Pdr is also enlarged in comparison with the others. The enlargement of the pitch distance Pdr causes the unevenness of the film thickness of the liquid developer on the developing roller 36.

The aspect of the transfer pattern formation on each roller in a case where as the recessed portion pattern, the helical groove 342 is formed in the supply roller 34 has been described above. However, also in a case where the other shape or array is used for the recessed portion pattern, the phenomenon of the unevenness of the film thickness based on the difference between the rotary peripheral velocity of the supply roller 34 and the rotary peripheral velocity of the intermediate roller 35 is confirmed. The invention is characterized in that the rotary peripheral velocity of the intermediate roller 35 is set to be slower than the rotary peripheral velocity of the supply roller 34 and the rotary peripheral velocity of the developing roller 36 in order to remove the unevenness of the film thickness of the liquid developer due to the transfer pattern.

Figure 6:
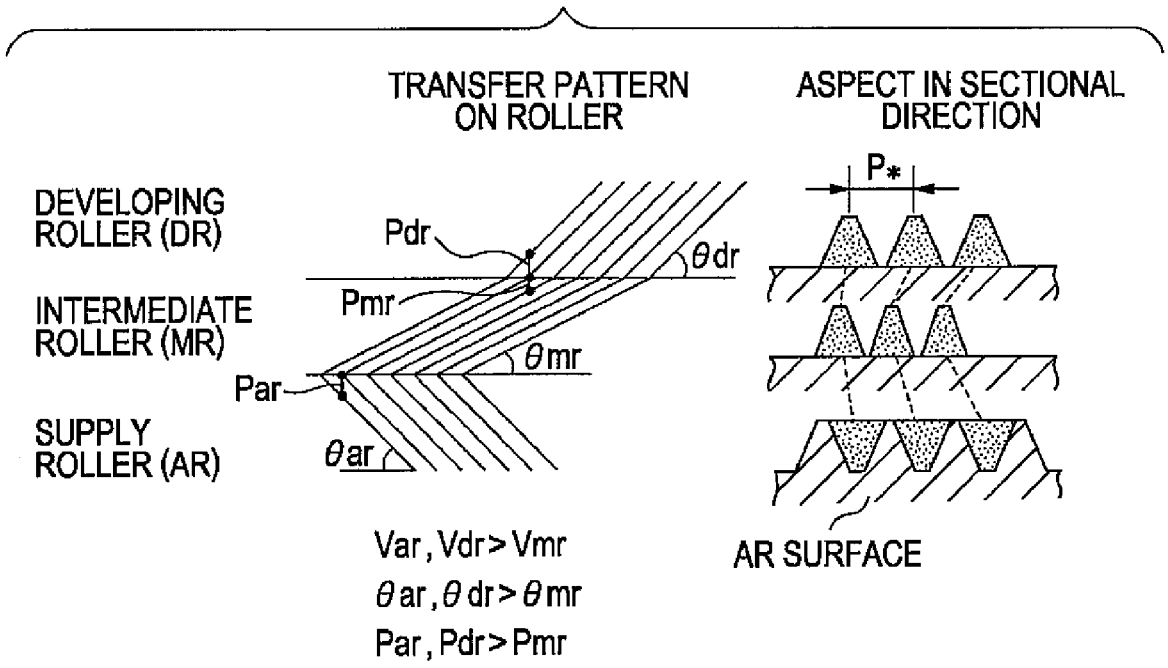
FIG. 6 is a view explaining the transfer pattern by the supply roller.

Then, the principle is described using the aspect of the transfer pattern in each roller shown in FIG. 6. FIG. 6 shows the aspect of the transfer patter on each roller in a case where the rotary peripheral velocity Vmr of the intermediate roller 35 is set to be slower than the rotary peripheral velocity Var of the supply roller 34 and the rotary peripheral velocity Vdr of the developing roller 36 (Var, Vdr>Vmr). In this case, since the rotary peripheral velocity of the intermediate roller 35 is set to be slower than the rotary peripheral velocity of the supply roller 34, the transfer pattern which is formed on the intermediate roller 35 becomes a laterally leaned state. Specifically, the acute angle θmr that the transfer pattern on the intermediate roller 35 makes with the axial direction becomes smaller than the acute angle θar that the helical groove 342 makes with the axial direction, and the pitch distance Pmr on the intermediate roller 35 becomes narrow.

In this manner, by once narrowly forming the pitch distance Pmr on the intermediate roller 35, also in a case where the pitch distance Pdr on the developing roller 36 set to be faster than the rotary peripheral velocity of the intermediate roller 35 is enlarged, it becomes possible to make the film thickness of the liquid developer to the extent that it does not become non-uniform. Accordingly, also in the case of thinly forming the liquid developer by making the rotary peripheral velocity of the developing roller 36 be faster than the intermediate roller 35, the enlargement of the pitch distance Pdr on the developing roller 36 is suppressed, so that uniformity of the liquid developer can be achieved. Also, the liquid developer suffers a shearing force due to the peripheral velocity difference between the supply roller 34 and the intermediate roller 35, thereby having lower viscosity, whereby a secondary effect capable of promoting smoothing is also obtained.

Figure 7:
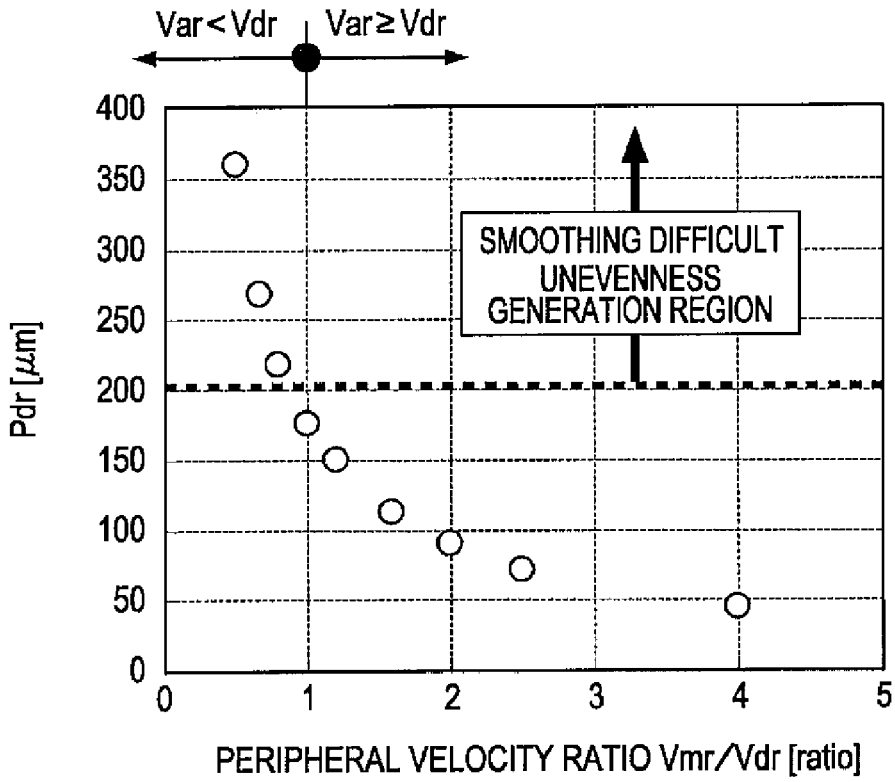
FIG. 7 is a view showing the relationship between a rotary peripheral velocity ratio and a pitch distance of a liquid developer on a developing roller in the past.
Figure 8:
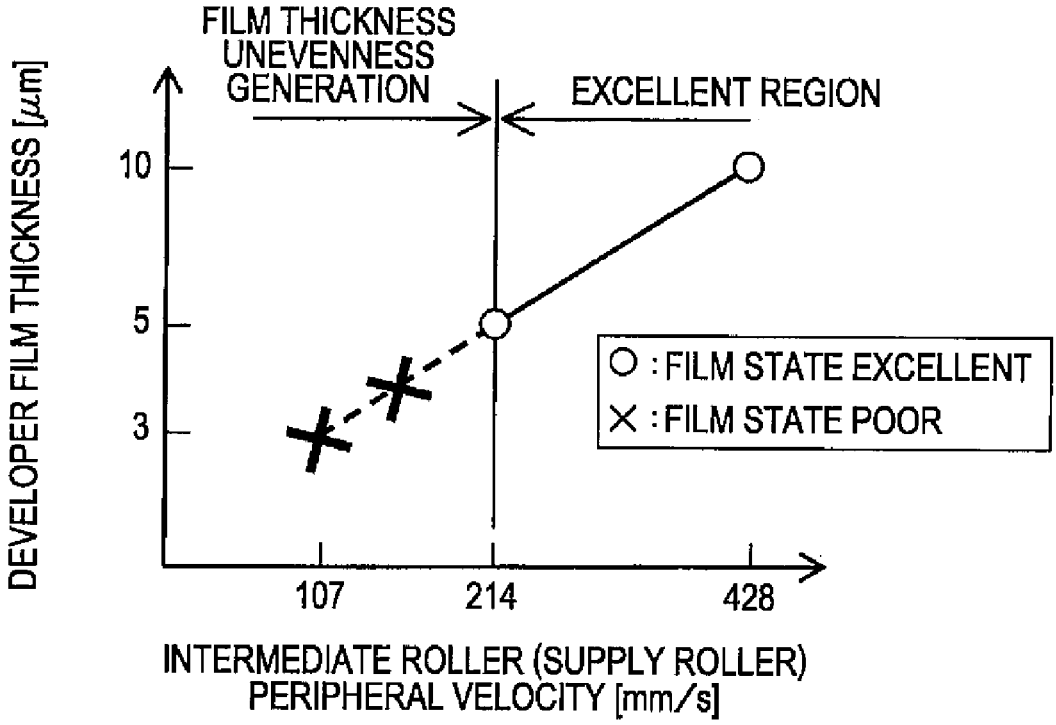
FIG. 8 is a view showing the relationship between a peripheral velocity of an intermediate roller and a developer film thickness in the past.
Figure 9:
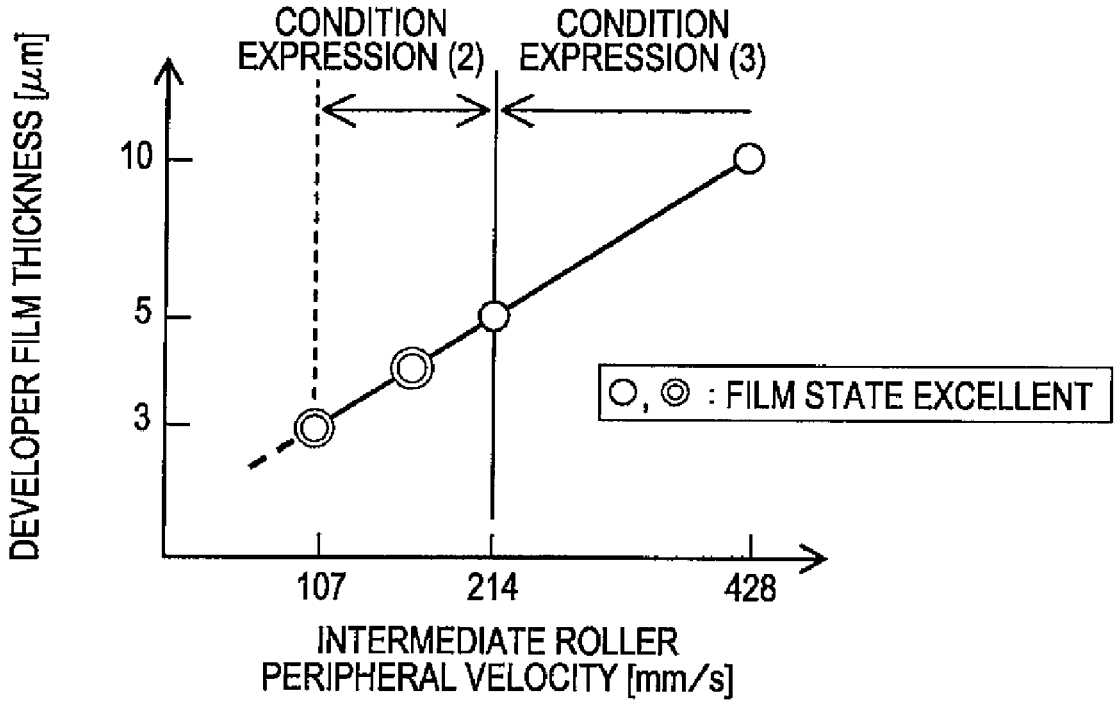
FIG. 9 is a view showing the relationship between a peripheral velocity of an intermediate roller and a developer film thickness, related to the embodiment of the invention.

Then, the relationship between the rotary peripheral velocity ratio of the intermediate roller 35 and the developing roller 36 and the liquid developer film which is formed on the developing roller 36 is described using FIGS. 7 to 9 while comparing with a prior example. FIG. 7 is a view showing the measurement results of the relationship between a roller peripheral velocity ratio (Vmr/Vdr) and a pitch distance Pdr of the transfer pattern of the liquid developer on the developing roller 36 in the past. This is a view showing the prior example, and the peripheral velocity of the supply roller 34 and the peripheral velocity of the intermediate roller 35 are set to be the same as each other. Further, the lines per inch of the helical groove 342 of the supply roller 34 are set to be 200 [LPI]. In the drawing, in the rotary peripheral velocity ratio which becomes Var<Vdr, it is confirmed that the pitch distance Pdr of the transfer pattern which was described in FIG. 5B becomes 200 [μm] or more and the liquid developer on the supply roller 34 is unsuitable for image formation due to the noticeable concavity and convexity of the transfer pattern. Accordingly, in the prior example where the peripheral velocity of the supply roller 34 and the peripheral velocity of the intermediate roller 35 are set to be the same as each other, it was necessary to maintain the relation of Var≧Vdr.

FIG. 8 is a view showing the measurement results of the film thickness of the liquid developer on the developing roller 36 with respect to the intermediate roller peripheral velocity Vmr (the same as the supply roller peripheral velocity Var) in the prior example. Here, the rotary peripheral velocity Vdr of the developing roller is fixed at 214 [mm/s] which is a process speed capable of printing 40 sheets per minute. Although the film thickness of the liquid developer basically is in a linear relationship with the peripheral velocity Vmr of the intermediate roller 35, in a case where the peripheral velocity Vmr of the intermediate roller 35 falls below the peripheral velocity Vdr of the developing roller (a case where the roller peripheral velocity ration Vmr/Vdr is smaller than 1), a concave and convex transfer pattern is formed in the film of the liquid developer which is formed, and this transfer pattern is also reproduced on a paper, thereby causing image deterioration.

On the other hand, in the invention, by setting the rotary peripheral velocity of the intermediate roller 35 to be slower than the rotary peripheral velocity of the supply roller 34 and the rotary peripheral velocity of the developing roller 36, the liquid developer film which is thin and in which the transfer pattern is unnoticeable can be formed on the developing roller 36. FIG. 9 is a view showing the measurement results of the relationship between the intermediate roller peripheral velocity Vmr and the film thickness of the liquid developer, similarly to FIG. 8. It is different from the case of FIG. 8 in that although the rotary peripheral velocity Vdr of the developing roller is fixed at 214 [mm/s], similarly to the case of FIG. 8, in a case where the rotary peripheral velocity Vmr of the intermediate roller 35 is set to be a smaller value than 214 [mm/s], setting is made such that the relation of Var>Vmr is established.

In a case where the rotary peripheral velocity of the intermediate roller 35 is set to be slower than the rotary peripheral velocity of the supply roller 34 and the rotary peripheral velocity of the developing roller 36 in the invention, since film thickness unevenness which was generated in the prior example of FIG. 8 can be suppressed, the peripheral velocity Vmr of the intermediate roller 35 can be lowered up to about 107 [mm/s], so that it is possible to thin the liquid developer film thickness on the developing roller 36 up to about 3 [μm].

Arranging the above-mentioned control of the rotary peripheral velocity of each roller, it can be found that three condition expressions as described below are established.

Here, the condition expression (1) is a condition which was used when the rotary peripheral velocity of the intermediate roller 35 was set to be 214 [mm/s] in FIG. 9. The condition expression (2) is a condition which was used when the rotary peripheral velocity of the intermediate roller 35 was set to be smaller than 214 [mm/s], and in the case of setting at the condition expression (2), a thin liquid developer film is formed on the developing roller 36, so that it becomes possible to accommodate to a paper having a smooth surface, and also form an image having high resolution. Further, since the invention has a feature that a thinner film thickness compared with the conventional film thickness can be realized, if the rotary peripheral velocity of each roller is set to satisfy at least the condition expression (2), it is sufficient.

Also, the condition expression (3) is a condition which was used when the rotary peripheral velocity of the intermediate roller 35 was set to be larger than 214 [mm/s], and in the case of setting at the condition expression (3), a lot of liquid developer are supplied on the developing roller 36, so that it becomes possible to form an image having high image density, and also accommodate to a paper having a rough surface. Also, at the condition expression (3), by making the peripheral velocity of the supply roller 34 and the peripheral velocity of the intermediate roller 35 be the same as each other, the intermediate roller 35 can be prevented from being damaged or broken by the recessed portion pattern formed in the supply roller 34.

Condition Expressions

The supply roller peripheral velocity Var=the intermediate roller peripheral velocity Vmr=the developing roller peripheral velocity Vdr (1)

The supply roller peripheral velocity Var, the developing roller peripheral velocity Vdr>the intermediate roller peripheral velocity Vmr (2)

The supply roller peripheral velocity Var=the intermediate roller peripheral velocity Vmr>the developing roller peripheral velocity Vdr (3)

Heretofore, the relationship between the intermediate roller peripheral velocity and the liquid developer film thickness in the prior example and the invention has been described using FIGS. 8 and 9. FIG. 10 shows some of the measurement values in these relations and the evaluation results of a developer film state. According to this table, in the conventional condition (Var=Vmr) in which there is not provided a peripheral velocity difference between the supply roller 34 and intermediate roller 35, the developer film thickness could be lowered only up to about 5 [μm]. However, in the condition of the invention in which there is provided a peripheral velocity difference between the supply roller 34 and intermediate roller 35, the developer film thickness can be lowered up to about 3 [μm], so that it becomes possible to improve the resolution of an image formed.

Figure 11:
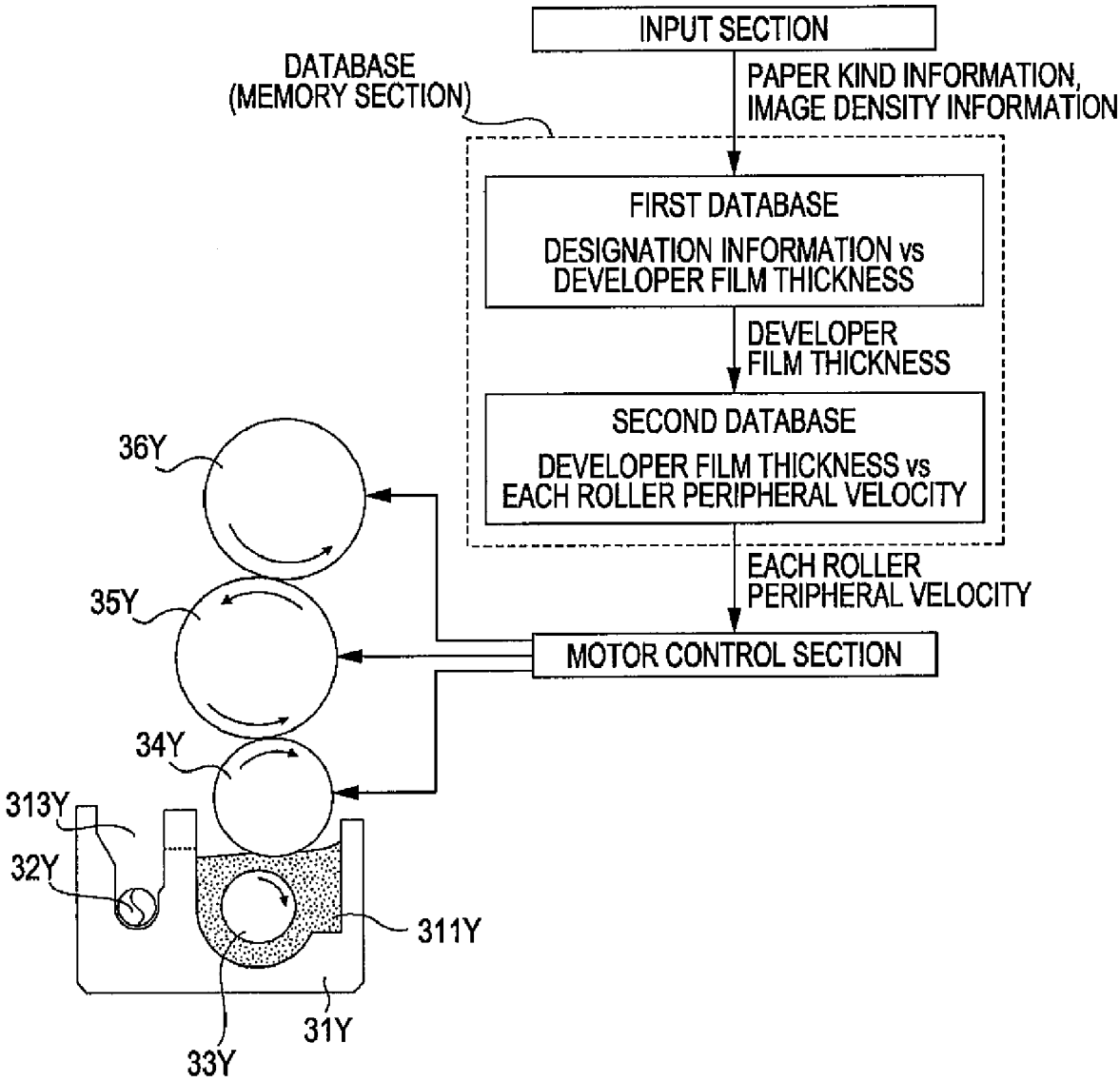
FIG. 11 is a view showing a configuration related to the control of the developing device.

Next, the drive control of each roller in the developing device 30 is described using FIG. 11. In FIG. 11, a control section which controls the driving of each roller includes an input section, a database stored in a memory section, and a motor control section. In this embodiment, a configuration is such that the rotary peripheral velocity of the developing roller 36 is fixed and the rotary peripheral velocity of the supply roller 34 and the rotary peripheral velocity of the intermediate roller 35 are changed. Therefore, the control section functions as a first changing section which changes the rotary peripheral velocity of the supply roller 34, and a second changing section which changes the rotary peripheral velocity of and intermediate roller 35. Further, it is also possible to adapt to each condition expression by controlling also the rotary peripheral velocity of the developing roller 36. In this case, it is necessary additionally to change the treatment speed of the component such as the intermediate transferring body 40 after the developing device 36.

The input section is configured such that a user arbitrarily can set designation information including paper information thereto. Therefore, the input section functions as a paper information input section. As for the paper information, information regarding to the name of a paper or the roughness of a paper is used. Also, the designation of the paper information is not to be limited to the designation by a user, but a configuration may also be adopted in which designation automatically is input, for example, by detecting the roughness of a used paper by a sensor or detecting an identification tag provided out of the use range of an exclusive paper by a sensor.

The database is constituted to include paper correspondence information which correlates the paper information with the rotary peripheral velocity of the supply roller 34, and at the database, the rotary peripheral velocity of the intermediate roller 35 and the rotary peripheral velocity of each roller can be determined corresponding to the input of the designated paper information. The database in this embodiment is constituted to hold two databases inside thereof. In the first database, the developer film thickness is correlated with the paper information, and in the second database, the rotary peripheral velocity of each roller is correlated with the developer film thickness. In this manner, by correlating them with the developer film thickness, it is possible simply to carry out correction according to the difference of a liquid developer or a temperature condition. The rotary peripheral velocity of each roller determined at the database is sent to the motor control section and each roller is driven by a driver, a motor, and a drive wheel train system.

By inputting the paper information, it is possible to make the film thickness of the liquid developer to be formed on the developing roller 36 a thickness suitable for the paper by this control section. Also, as information to designate, in place of or in addition to the paper information, image density information which is designated by a user may also be adopted. In the case of adopting the image density information in place of the paper information, the input section functions as an image density information input section, and the database is constituted to include image density correspondence information which correlates the image density information with the rotary peripheral velocity of the supply roller 34 and the rotary peripheral velocity of the intermediate roller 35. Also, in the case of adopting the image density information in addition to the paper information, it is conceivable to use correspondence information which correlates the rotary peripheral velocity of each roller with both of the paper information and the image density information, or use the paper correspondence information corrected on the basis of the input image density information.

Also, since the film thickness of the liquid developer undergoes a change also according to the solid content amount thereof or the dispersion state and content ratio of a pigment, the first database may also be corrected by detecting a liquid developer state. Specifically, an optical reflection sensor which detects the state of the liquid developer on the developing roller 36 or the intermediate transferring body 40 is disposed and the correction of the first database is performed in accordance with the detected liquid developer state. According to this configuration, it is possible further to stabilize the concentration of the liquid developer on the paper.

Also, since the liquid developer is changed in property according to a temperature, the second database may also be corrected according to a temperature. By performing correction considering the influence of a temperature on the liquid developer, a change of the liquid developer film thickness can be suppressed. Further, provided that the database can determine the rotary peripheral velocity of each roller on the basis of the paper information or the image density information, it is not to be limited to the database as in this embodiment constituted of the first database and the second database, but may also be appropriately designed. Further, it is possible to adopt the correction of the database to an appropriate form corresponding to a liquid developer state, a change in temperature, and the like.

FIG. 12 shows one example of a condition that image density becomes constant in paper kinds different in roughness. By preparing a database suitable for the condition, the image density suited to a paper kind can be obtained. Also, this table shows a condition that optical density of 1.5 can be obtained in the respective paper kinds different in surface roughness. In the case of a standard paper which is a default, by applying the condition expression (1) to the peripheral velocity of each roller, the film thickness of the liquid developer on the developing roller 36 is set to become 5 [μm].

Also, in the case of a coated paper which is smoother than a standard paper, by applying the condition expression (2) to the peripheral velocity of each roller, the film thickness of the liquid developer is set to become about 3 [μm]. Also, in the case of a rough paper which is rougher than a standard paper, by applying the condition expression (3) to the peripheral velocity of each roller, the film thickness of the liquid developer is set to become 8 [μm]. By thinly forming the film thickness of the liquid developer on the developing roller 36 in the case of the coated paper and thickly forming the film thickness of the liquid developer in the case of the rough paper according to these conditions, it is possible to secure a constant concentration even on different papers. Although in this embodiment, three kinds of a standard paper, a coated paper, and a rough paper has been described, the kind of a paper is not limited to this embodiment, but it is possible to accommodate to various papers by classifying more finely.

Although various embodiments of the invention have been described above, the invention is not to be limited to these embodiments, but an embodiment constituted appropriately by combining the configurations of the respective embodiments also comes within the scope of the invention.

The entire disclosure of Japanese Patent Application No: 2008-276325, filed Oct. 28, 2008 is expressly incorporated by reference herein.

What is claimed is:

1. A developing device comprising:

a developer storage portion that stores a liquid developer including toner and carrier liquid;

a first coating member that rotates and coats the liquid developer stored in the developer storage portion;

a second coating member that comes into contact with the first coating member and rotates in a direction opposite to that of the first coating member and slower than a rotary peripheral velocity of the first coating member; and a developer supporting body that comes into contact with the second coating member and rotates in the same direction as that of the second coating member and faster than a rotary peripheral velocity of the second coating member, wherein the rotary peripheral velocity of the developer supporting body is equal to or less than the rotary peripheral velocity of the first coating member.

2. The developing device according to claim 1, further comprising:

a first changing section that changes the rotary peripheral velocity of the first coating member; and a second changing section that changes the rotary peripheral velocity of the second coating member.

3. An image forming apparatus comprising:

a developing section including a developer storage portion that stores liquid developer, a first coating member that rotates and coats the liquid developer stored in the developer storage portion, a second coating member that comes into contact with the first coating member and rotates in a direction opposite to that of the first coating member and slower than a rotary peripheral velocity of the first coating member, and a developer supporting body that comes into contact with the second coating member and rotates in the same direction as that of the second coating member and faster than a rotary peripheral velocity of the second coating member, wherein the rotary peripheral velocity of the developer supporting body is equal to or less than the rotary peripheral velocity of the first coating member; and a latent image supporting body that is developed by the developing section.

4. The image forming apparatus according to claim 3, further comprising:

a first changing section that changes the rotary peripheral velocity of the first coating member; and a second changing section that changes the rotary peripheral velocity of the second coating member.

5. The image forming apparatus according to claim 4, further comprising:

a paper information input section that inputs paper information;

a memory section having paper correspondence information that correlates the paper information with the rotary peripheral velocity of the first coating member and the rotary peripheral velocity of the second coating member; and a control section that controls the rotary peripheral velocity of the first coating member and the rotary peripheral velocity of the second coating member on the basis of the paper correspondence information.

6. The image forming apparatus according to claim 4, further comprising:

an image density information input section that inputs image density information;

a memory section having image density correspondence information that correlates the image density information with the rotary peripheral velocity of the first coating member and the rotary peripheral velocity of the second coating member; and a control section that controls the rotary peripheral velocity of the first coating member and the rotary peripheral velocity of the second coating member on the basis of the image density correspondence information.

7. The image forming apparatus according to claim 4, further comprising:

an input section that inputs paper information and image density information;

a memory section having correspondence information that correlates the paper information and the image density information with the rotary peripheral velocity of the first coating member and the rotary peripheral velocity of the second coating member; and a control section that controls the rotary peripheral velocity of the first coating member and the rotary peripheral velocity of the second coating member on the basis of the correspondence information.

8. A developing method comprising:

coating, by a rotating first coating member, a liquid developer including toner and carrier liquid, that is stored in a developer storage portion, on a second coating member that contacts the first coating member, rotates in a direction opposite to that of the first coating member and has a rotary peripheral velocity slower than a rotary peripheral velocity of the first coating member; and coating, by the second coating member on which the liquid developer has been coated, the liquid developer on a developer supporting body that rotates in the same direction as that of the second coating member and has a rotary peripheral velocity faster than the rotary peripheral velocity of the second coating member, wherein the rotary peripheral velocity of the developer supporting body is equal to or less than the rotary peripheral velocity of the first coating member.

* * * * *